US006477870B1

(12) United States Patent
Derman

(10) Patent No.: US 6,477,870 B1
(45) Date of Patent: Nov. 12, 2002

(54) CABLE END TUBULAR LOCK

(76) Inventor: Jay S. Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 10/036,895

(22) Filed: Jan. 4, 2002

(51) Int. Cl.[7] ..... E05B 67/06
(52) U.S. Cl. ..... 70/49; 70/18
(58) Field of Search ..... 70/14, 18, 30, 70/49, 57, 58

(56) References Cited

U.S. PATENT DOCUMENTS

| | | | | | |
|---|---|---|---|---|---|
| 2,623,378 | A | * | 12/1952 | Haver | 70/49 |
| 2,643,787 | A | * | 6/1953 | Rockman | 70/57 X |
| 3,765,196 | A | * | 10/1973 | Balicki | 70/49 |
| 4,075,878 | A | * | 2/1978 | Best | 70/49 |
| 4,136,539 | A | * | 1/1979 | Nobles et al. | 70/18 |
| 4,325,238 | A | * | 4/1982 | Scherbing | 70/18 |
| 4,476,699 | A | * | 10/1984 | Dahlborg | 70/57 X |
| 4,667,491 | A | * | 5/1987 | Lokken et al. | 70/18 X |
| 4,669,281 | A | * | 6/1987 | Young | 70/57 |
| 4,790,159 | A | * | 12/1988 | Quinn | 70/57 X |
| 4,819,464 | A | * | 4/1989 | Kuo | 70/18 |
| 4,970,883 | A | * | 11/1990 | Johnson | 70/30 |
| 5,119,649 | A | * | 6/1992 | Spence | 70/14 |
| 5,170,650 | A | * | 12/1992 | Kortenbrede | 70/49 |
| 5,406,810 | A | * | 4/1995 | Chen | 70/18 |
| 5,447,043 | A | * | 9/1995 | Hwang | 70/49 |
| 5,481,888 | A | * | 1/1996 | Perry | 70/18 |
| 5,560,232 | A | * | 10/1996 | Chen | 70/30 |
| 5,568,740 | A | * | 10/1996 | Lin | 70/49 |
| 5,752,416 | A | * | 5/1998 | Nien | 70/18 X |
| 5,829,280 | A | * | 11/1998 | Chen | 70/49 |
| 5,916,283 | A | * | 6/1999 | Steinbach | 70/49 X |
| 5,992,187 | A | * | 11/1999 | Derman | 70/58 |
| 6,055,832 | A | * | 5/2000 | Wyers | 70/18 X |
| 6,227,017 | B1 | * | 5/2001 | Igelmund | 70/58 |
| 6,364,339 | B1 | * | 4/2002 | Lee | 70/14 X |

* cited by examiner

*Primary Examiner*—Suzanne Dino Barrett
(74) *Attorney, Agent, or Firm*—Monty Koslover

(57) ABSTRACT

A cable end locking device that is used for securing the swaged end of a cable that is attached to a portable equipment. The device is simple, having only three parts: a tubular shell with an axial hole in one end for inserting a cable end, a tubular piston with an axial bore that is located inside the shell, and a key-operated cylinder lock that locks the piston in place. The piston bore hole and shell end hole are offset, which reduces the cable aperture, so that when locked, an inserted cable end can not be pulled out of the shell hole. An alternative embodiment of the device does not use a cylinder lock as the locking means. Instead, means are provided for a wire rope, cable, shaft or padlock to be used to lock the piston in place. The device can also be used to secure the end of a shaft.

4 Claims, 2 Drawing Sheets

CABLE END TUBULAR LOCK

BACKGROUND OF THE INVENTION

1. Field of the Invention

This invention relates to devices for securing small portable equipment from theft, and more particularly to a gripping device for securing electrical cords or cables that are attached to portable electrical equipment.

2. Background

Portable computers, related equipments and other portable items can use a cable having a bulbous end on one end and a swaged end on the opposite end. It would be desirous to have a low cost, simple device to quickly secure the swaged end of a fastening cable for either private security use or for a sales display. The connector cables that are attached to some portable equipments can also use a cable end locking device for security.

SUMMARY OF THE INVENTION

The invention is a cable end locking device that is used for securing the swaged end of a cable that is attached to a portable equipment. There are two versions of the device. The first device comprises a cylindrical housing shell with a central hole in one end for inserting a cable end, a cylindrical piston that incorporates an axial bore and is located inside the shell, and a key-operated cylinder lock that locks the piston in place. The piston bore hole and the shell end hole are offset, and when placed together, create an aperture reduced in size so that any previously inserted cable ends can not be withdrawn from the piston bore and shell hole. An alternative embodiment of the device does not use a cylinder lock as the locking means. Instead, holes are bored through the side of the shell and through the piston so that a wire rope, cable, shaft or padlock can be used to lock the piston in place.

The principal object of the present invention is to provide a device that is useful for securing the swaged cable ends of cables that are attached to portable computers and the like. The ends of shafts can also be so secured.

Another object is to provide a cable end locking device that is simple in construction, economic in manufacture and easy to use.

Further objects and advantages of the invention will be apparent from studying the following portion of the specification, the claims and the attached drawings.

DESCRIPTION OF THE PREFERRED AND ALTERNATE EMBODIMENTS

Figure 1:
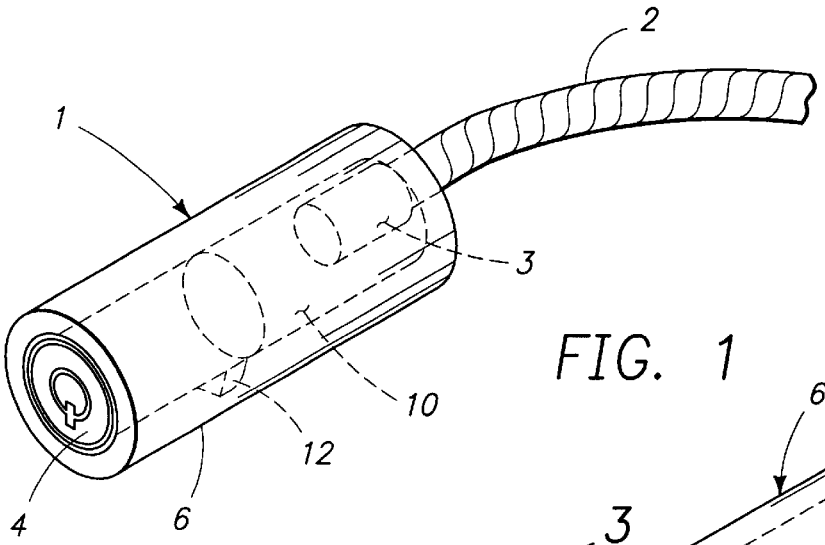
FIG. 1 is a perspective view of a preferred embodiment of the present invention lock, showing a cable attached by its swaged end to the device.

Referring particularly to the drawings, there is shown in FIG. 1 a perspective view of a preferred embodiment of the present invention cable end locking device 1. In this view, a cable 2 is shown with its swaged end 3 inserted in an axial hole in the end of a cylindrical shell 6 that forms the body of the device. Inside the shell 6, there is located a cylindrical piston 10 that is pushed against the axial hole at the cable end of the shell 6 by an inserted cylinder lock 4. The swaged end 3 of the cable 2 is inserted into an offset axial bore in the piston 10, so that when the piston bore opening is held against the axial hole in the shell end, the offset axial position of the piston bore opening with respect to the shell axial hole prevents removal of the cable 2 from the device 1.

Figure 2:
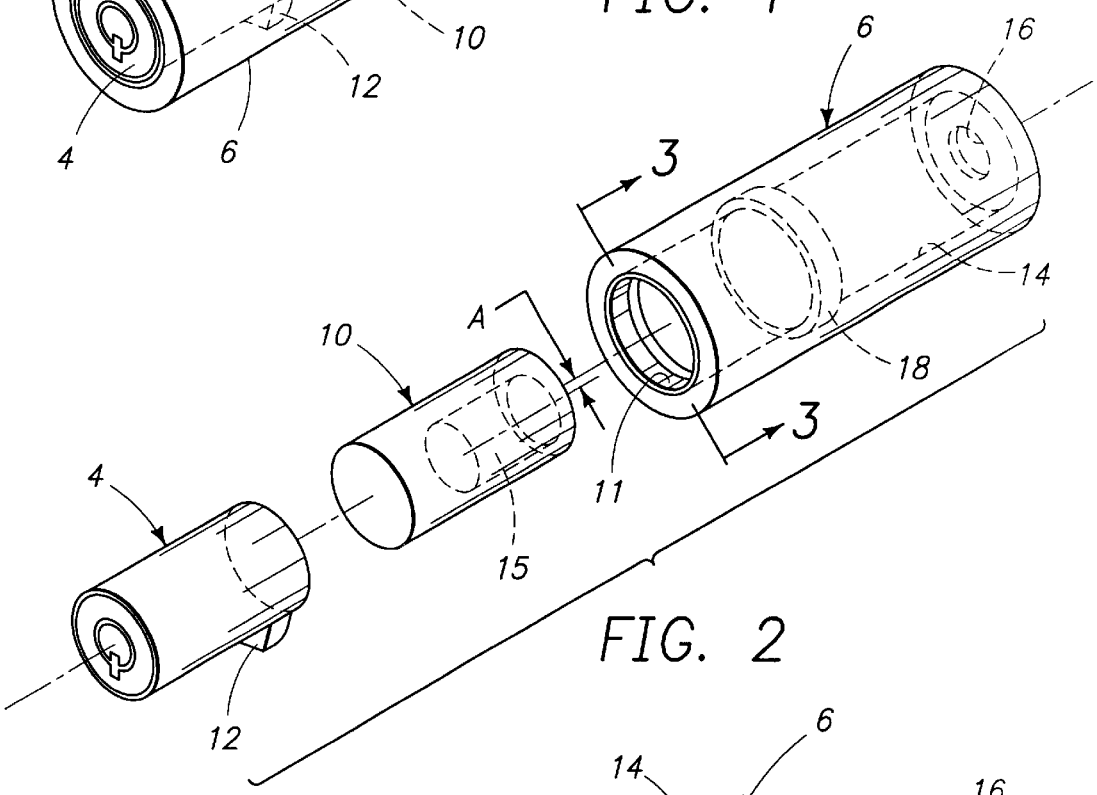
FIG. 2 is an exploded view of the preferred embodiment device according to the present invention.

The device comprises three components which are: a shell 6, a piston 10 and a cylinder lock plug 4 which are shown in the exploded view of FIG. 2. Both the piston 10 and cylinder lock plug 4 fit snugly within the shell 6 when the device 1 is locked. When the device 1 is unlocked by a key, the lock plug 4 can be pulled out of the shell 6 a little, allowing the piston 10 to move away from the hole in the shell end. At this point, a cable end may be inserted in the shell end and into a bore in the piston 10, or a previously inserted cable may be withdrawn.

Figure 3:
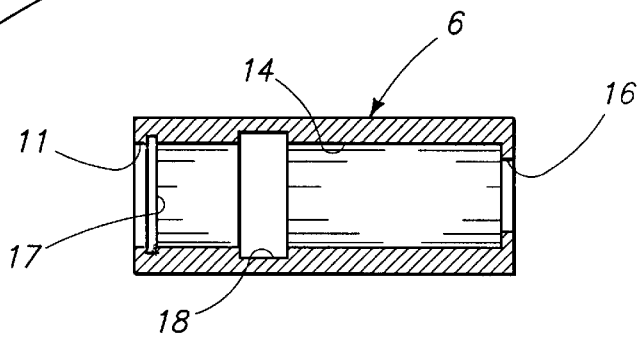
FIG. 3 is a cross-section view of the device housing shell taken along line 3—3 of FIG. 2, particularly showing the deep circular groove by which a cylinder locking cam engages with the device tubular housing shell when assembled.

Refer now to FIG. 2 and to FIG. 3 which is a cross-section view of the shell 6 taken along line 3—3 of FIG. 2, for the following discussion of the device components.

The shell 6 is made of a hard, rigid material and includes an axial, cylindrical cavity 14 having an opening 11 at one end and extending to near the shell distal end. An axial first hole 16, that is sized to permit passage of a cable swaged end, is cut in the shell distal end and centered on the shell longitudinal axis. As shown in FIG. 3, two circumferential grooves are cut in the surface of the shell cavity 14. These are a first groove 17, which is located near the cavity opening 11 and a second groove 18, which is located a distance further from the cavity opening 11. The first groove 17, which is narrow and of a shallow depth, is sufficient to snag the front edge of an unlocked cylinder locking cam 12 and prevents the cylinder lock plug 4 from accidentally falling out of the shell 6. The second groove 18 is made wide and deep to accommodate the locking cam 12. This groove 18 is located so that when the locking cam is made to enter the groove, the end of the lock plug 4 will bear against the piston 10, thus holding the piston against the shell end.

The piston 10 is a cylindrical member sized to fit closely and slidingly inside the axial cavity 14 of the shell 6. An axial bore 15, having the same diameter as the first hole 16 in the shell 6 end, is bored in one end of the piston. However, the longitudinal axis of the bore 15 is offset from the longitudinal axis of the piston 10 by an amount "A" which is about 2 mm. The bore is offset so that when the bore opening in the piston end is held against the first hole 16 at the end of the shell 6, the peripheries of the two openings will overlap and the resulting aperture will be too small to allow withdrawing an inserted cable end 3 from the shell 6.

Figure 4:
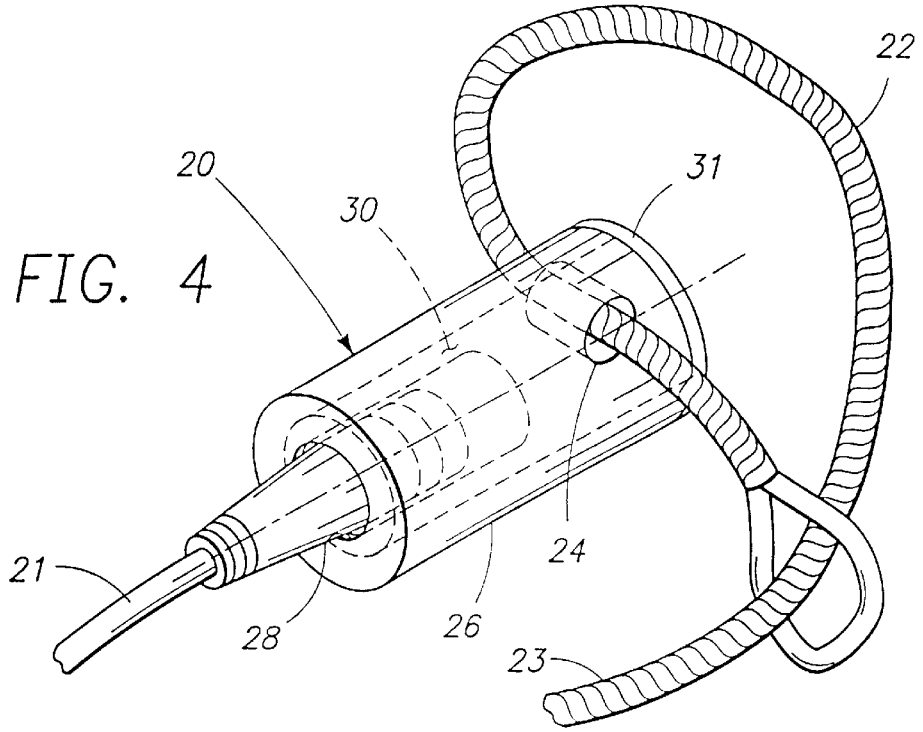
FIG. 4 is a perspective view of an alternate embodiment of the present invention lock, showing a securing cable passed through a hole in the side of the device housing shell and locking a connector swaged cable end inside one end of the device.

For applications such as a store display, where it is desired to secure the cable connector ends of a number of displayed equipments together, an alternate cable end locking device would be useful. This function is performed by an alternate embodiment of the invention cable end locking device as shown in FIG. 4. A single fastening cable 22 can be passed through a number of the devices 20, securing a number of equipments, before securing with a lock. Or the fastening cable 22 may be used for only a single equipment cable connector as illustrated in FIG. 4.

FIG. 4 depicts the alternate embodiment of the invention cable end locking device 20 securing the end of a connector cable 21 that is inserted in an axial opening 28 in one end of the device 20. The device 20 comprises a cylindrical shell 26 and an internal piston 30, and will secure any cable swaged end in the same manner as that described earlier for the preferred embodiment. However, this alternate embodiment does not require a cylinder lock to hold the internal piston 30 in place. Instead, a fastening cable 22 may be passed through a radial hole 24 in the periphery of the device shell 26 and through a hole in the piston 30. The fastening cable 22 may then have its end 23 secured by any convenient method.

Alternatively, a padlock arm may be used in place of the illustrated fastening cable 22 to lock the device 20. A wire cable having a bulbous end and a distal swaged end could also be used as the locking device to pass through the locking hole and be secured by a lock.

Figure 5:
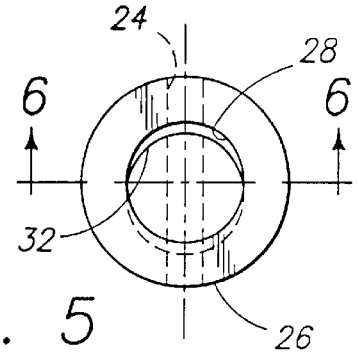
FIG. 5 is an end view of an assembled alternate embodiment device, particularly showing the aperture that secures the swaged end of an inserted connector cable.
Figure 6:
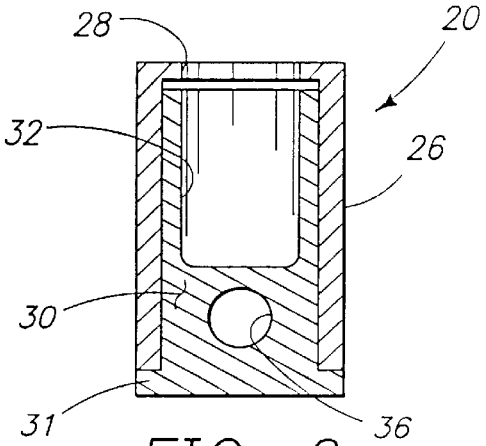
FIG. 6 is a cross-section elevation view of the alternate embodiment device taken along line 6—6 of FIG. 5, particularly showing a piston with a projecting rim at one end, placed inside the device shell, and showing detail of an axial bore in the piston.

Refer now to FIGS. 5–8. FIG. 5 shows the opening end of the assembled device 20, particularly showing how the bore. 32 opening of the internal piston 30 offsets the axial end hole 28 of the shell 26. FIG. 6 is a cross-section view of the assembled device 20, showing a side view of the piston bore 32 and the shell end hole 28. It is notable that the bore hole end of the piston 30 does not need to impinge directly on the inside surface of the shell end, but only be close to it. This is performed by including a rim 31 at the distal and external end of the piston and sizing the length of the piston to approximate the depth of the shell 26 internal cavity.

As shown in FIG. 5, location of the piston 30 within the shell 26 reduces the end aperture by overlapping and reduces the aperture sufficiently to grip a cable end and prevent removal or insertion of a cable swaged or connector end.

To facilitate locking the device, the locking holes 24 in the shell 26 periphery are lined up with a horizontal through hole 36 in the piston 30. Lining up these holes is easily done by manual rotation of the piston 30, using its projecting rim 31.

Figure 7:
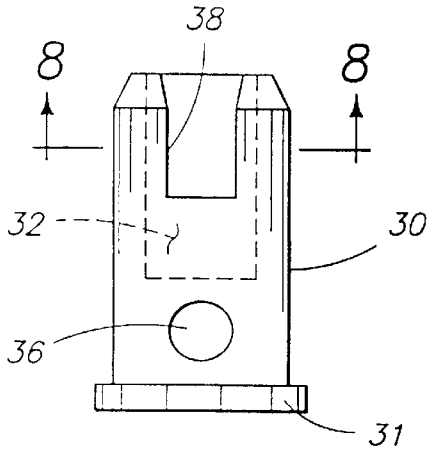
FIG. 7 is a side elevation view of the piston particularly showing a cut-out portion in the wall of the axial bore at the bore opening.

Refer now to FIG. 7 which is an elevation view of the piston 30. This drawing has been enlarged, with some features exaggerated for the sake of clarity. The piston 30 fits closely and smoothly into the shell axial cavity, and is positioned by use of a projecting rim 31. The rim 31 is also provided for grasping when pulling the piston out of the shell cavity.

Figure 8:
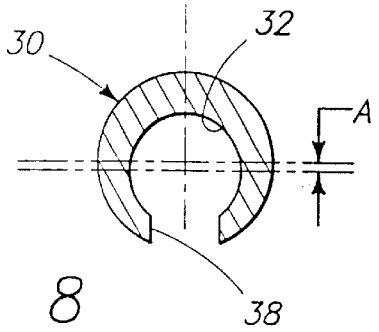
FIG. 8 is a cross-section view of the bore opening end of the piston, taken along line 8—8 of FIG. 7, particularly showing the axial offset of the bore opening.

FIG. 8 is a cross-section view taken along line 8—8 of FIG. 7 and particularly shows the axial offset "A" of the piston bore 32. A cut-out 38 in the wall of the bore 32, provides a little extra clearance for a projecting spline that is included on the end of some types of electrical connector.

The shell 26 and piston 30 are fabricated from a rigid, hard material and may be machined or formed, according to the material selected. Their manufacture is seen as being economic in quantity and therefore, relatively inexpensive.

The same is true for the shell 6 and piston 10 of the preferred embodiment device, which however, requires a cylinder lock. Both the preferred and alternative devices are simple to use, economical to produce and may be sized to closely fit and secure the ends of any electrical cords, cables or shafts. The alternative device can accommodate any selected wire rope, cable, shaft or padlock for securing purposes.

From the foregoing description, it is believed that the preferred and alternate embodiments achieve the objects of the present invention. Various modifications and changes may be made to the cable end locking device described above which are apparent to those skilled in the art. These alternatives and modifications are considered to be within the scope of the appended claims and are embraced thereby.

What is claimed is:

1. A locking device for securing a cable or shaft end, said locking device comprising;

(a) a cylindrical housing shell; said shell including a cylindrical cavity that is concentrically disposed along a longitudinal axis, said shell having a circular opening to said cavity at one end, and an axial circular first hole which is cut in a distal end and defines a cable entry end, said first hole being sized to allow passage of a swaged end of a cable;

(b) a cylindrical piston that fits in the opening and cavity of said shell in sliding engagement with an inner wall surface of said cavity; said piston including a bore opening in one end to a cylindrical bore that extends axially from said bore opening for a distance sufficient to accommodate an entire swaged end of a cable; said bore having a longitudinal axis that is laterally offset approximately 2 mm from the longitudinal axis of said piston; said bore opening having a diameter identical to the diameter of said first hole in said cable entry end of said shell; and, (c) means for locking said piston inside said shell and holding said bore opening in an end of said piston in close contact with said cable entry end of said shell; said means for locking said piston inside said shell including a cylinder lock plug that is sized to fit slidingly into the cavity opening in an end of said shell until an end of said cylinder lock plug abuts said piston; said cylinder lock plug including a locking cam which protrudes radially from a side; and, a wide, deep groove that is cut circumferentially in a wall surface of said cavity in said shell, said deep groove being located to engage said locking cam of said cylinder lock plug when said piston is placed fully inside said cavity;

said cylinder lock plug, when being manually locked by a key, causing said locking cam to become engaged by said deep groove and to lock said piston in place against said cable entry end of said shell;

said bore opening in an end of said piston, when held in close contact with said cable entry end of said shell, resulting in an overlapping of said bore opening and said first hole radial peripheries, creating a non-circular diminished size aperture that prevents the withdrawal of any cable swaged end that may have been previously inserted into said shell and into said bore of said piston.

2. The locking device as defined in claim 1 wherein:

said means for locking said piston inside said shell further includes:

a narrow, shallow groove that is cut circumferentially in the wall surface of said cavity in said shell and is located near the cavity opening, said shallow groove acting to snag a projecting edge of said locking cam when said cylinder lock plug is unlocked and about to be withdrawn, preventing said cylinder lock plug from accidentally falling out of said shell.

3. A locking device for securing a cable or shaft end, said locking device comprising;

(a) a cylindrical housing shell; said shell including a cylindrical cavity that is concentrically disposed along a longitudinal axis, said shell having a circular opening to said cavity at one end, and an axial first hole that communicates with said cavity cut in a distal end, defining a cable entry end, said first hole being sized to allow passage of a swaged end of a cable;

said shell including a radial second hole in the peripheral surface of said shell, and a radial third hole in said shell that is diametrically opposed to said second hole; said second hole and said third hole being located adjacent to the circular opening to said cavity, said second hole and said third hole being sized to allow passage therein of a fastening cable, wire rope, shaft or padlock; and (b) a cylindrical piston; said piston having a shaft portion and a stepped end portion, said shaft portion being adapted to fill said cavity in said shell in sliding engagement with walls of said cavity, said stepped end portion having a circular, flat end surface which extends beyond the periphery of said shaft portion, forming a substantially edged rim that can be manually grasped for adjustment of piston position in said shell;

said shaft portion including an opening in a free end for a cylindrical first bore that extends axially from said opening for a distance sufficient to accommodate an entire swaged end of a cable; said first bore having a longitudinal axis which is laterally offset approximately 2 mm from the longitudinal axis of said piston; said first bore having an opening diameter that is identical to the diameter of said first hole in said cable entry end of said shell; said shaft portion including a second bore that is cut diametrically through said shaft portion, said second bore having approximately the same diameter as said second hole and said third hole in said shell; said second bore being located so that when said shaft portion is pushed all the way into said cavity in said shell, said second bore will line up with said second hole and said third hole in said shell, creating a passage for insertion of a fastening cable or other fastening to lock said piston in said shell;

said opening at said free end of said shaft portion, when held in close contact with said cable entry end of said shell, resulting in an overlapping of said opening to said first bore and said first hole radial peripheries, creating a non-circular diminished size aperture that prevents the withdrawal of any cable swaged end that may have been previously inserted into said shell and into said first bore of said piston.

4. The locking device as defined in claim 3 wherein: said shaft portion of said piston includes a longitudinal cut-out portion in the wall of said first bore, starting at said opening of said first bore; said cut-out portion providing extra clearance for a projecting spline or other projection that may be affixed on the side of any cable end that is intended to be inserted in said first bore in said piston which is in said shell.

* * * * *